US006131674A

United States Patent [19]

Draney et al.

[11] Patent Number: 6,131,674

[45] Date of Patent: Oct. 17, 2000

[54] GRIPPING APPARATUS FOR RESISTING SLIDING OF DRILLING MACHINE

[75] Inventors: Robert Draney, Forest Lake; Jeffrey Volden, North St. Paul, both of Minn.

[73] Assignee: Case Corporation, Racine, Wis.

[21] Appl. No.: 09/303,506

[22] Filed: Apr. 30, 1999

[51] Int. Cl.[7] ..... E21B 15/04

[52] U.S. Cl. ..... 175/122; 173/31; 173/32

[58] Field of Search ..... 175/122, 162, 175/203; 166/96.1; 280/763.1, 766.1; 173/31, 32, 36, 37; 299/33

[56] References Cited

U.S. PATENT DOCUMENTS

| | | | |
|---|---|---|---|
| Re. 35,669 | 11/1997 | Paskey et al. | 280/763.1 |
| 3,365,214 | 1/1968 | Garnett | 280/763.1 |
| 3,930,668 | 1/1976 | Schuermann et al. . | |
| 3,976,306 | 8/1976 | Nault . | |
| 4,023,828 | 5/1977 | MacKenzie et al. | 280/763 |
| 4,039,206 | 8/1977 | Nault . | |
| 4,473,239 | 9/1984 | Smart . | |
| 4,491,450 | 1/1985 | George . | |
| 4,953,638 | 9/1990 | Dunn | 175/162 |
| 4,966,417 | 10/1990 | Zitz et al. | 299/33 |
| 5,231,899 | 8/1993 | Lee | 81/57.16 |
| 5,253,721 | 10/1993 | Lee | 175/73 |
| 5,340,199 | 8/1994 | Piefenbrink et al. | 299/33 |
| 5,667,245 | 9/1997 | Lagsdin . | |
| 5,709,276 | 1/1998 | Lee | 175/122 |

*Primary Examiner*—Brian L. Johnson
*Assistant Examiner*—Joselynn Z. Sliteris
*Attorney, Agent, or Firm*—Jansson, Shupe, Bridge & Munger, Ltd.

[57] ABSTRACT

A gripping apparatus for resisting sliding of a drilling machine in first and second directions during drilling operations is provided. The gripping apparatus is pivotably mounted on the anchoring assembly of the drilling machine. The drilling machine includes a reciprocating drill mounted on the boom thereof. During operation of the drilling machine, the reciprocating drill generates thrust and pull-back forces which tend to move the drilling machine in the first and second directions, respectively. The gripping apparatus for resisting sliding of the drilling machine in first and second directions during drilling operations includes first and second gripping mechanisms which are moveable between a first disengaged storage position and a second support surface engaging, work position. Each of the first and second gripping mechanisms include a plate from which a plurality of teeth extend, the teeth being for gripping the support surface, and a plurality of arms which are perpendicular to the plate and which have holes therethrough for mating with a fastener to pivotably attach the gripping mechanisms to anchoring assembly. The first gripping mechanism is pivotably mounted on a front of the anchoring assembly for resisting sliding of the drilling machine in the first direction and the second gripping mechanism is pivotably mounted on a rear of the anchoring assembly for resisting sliding of the drilling machine in the second direction.

19 Claims, 3 Drawing Sheets

GRIPPING APPARATUS FOR RESISTING SLIDING OF DRILLING MACHINE

FIELD OF THE INVENTION

The present invention generally relates to drilling machines and, more particularly, to anchoring assemblies to stabilize the locations of drilling machines during drilling operations.

BACKGROUND OF THE INVENTION

One type of conventional boring or drilling machine is shown in U.S. Pat. Nos. 5,709,276, 5,253,721, and 5,231,899. These patents disclose a horizontal directional drilling machine pivotally mounted on a tracked vehicle or tractor. An anchor bar extends outwardly from the frame of the tractor and supports anchoring stakes. The anchoring stakes are driven into the support surface in an attempt to stabilize the drilling machine in place during drilling operations.

A drilling machine of the type described above may also include a directional drill bit which is "steerable" and which is mounted on the end of a flexible drill stem. Such a drill is often used for drilling holes, for instance, for installing flexible fiber-optic cable underground, for laying electric cable underground, or similar applications. The fact that the drill is steerable permits a user of the drill to drill under roadways, driveways, sidewalks, and similar, without disturbing the surface thereof. With the conventional drilling machine described above, drilling operations usually are initiated at an angle of approximately 15 degrees. However, once the drill bit is underground, it can be steered to drill a long passageway and then withdrawn when the work is completed. This field of technology is known as directional drilling.

Although the horizontal directional drilling machines discussed above disclose the use of anchoring stakes as the preferred type of anchoring assembly, many different types of anchoring assembly are commonly known For instance, U.S. Pat. No. 3,930,668 discloses a stabilizer foot for backhoes or similar construction equipment which have a plurality of ground engaging faces for use in stabilizing according to differing ground surfaces. The stabilizer foot includes a detachable pad which may be pivotally attached to the stabilizer arm and retained in selected different orientations, with each orientation providing a ground engaging face. One of the ground engaging faces has cleats thereon for digging into the ground and another ground engaging face has resilient projections for resiliently engaging a pavement surface to stabilize, but not dig into or damage the surface.

U.S. Pat. Nos. 3,976,306 and 4,039,206 both disclose attachments for ground-engaging pads of stabilizer arms of material-handling apparatus, one attachment being for engaging rough terrain via penetrating into the ground and the other attachment being for engaging smooth terrain via a rubber surface for gripping, but not being embedded in the ground, respectively.

U.S. Pat. No. 4,023,828 discloses a stabilizer pad for attachment to an arm of a piece of earthmoving equipment such as a backhoe. The stabilizer pad has three surfaces. A first surface has cleats thereon for being embedded in a hard terrain. A second surface has a resilient pad thereon for engaging the ground to prevent slippage, but which does not become embedded. A third surface has a flange thereon for becoming embedded in a soft soil.

U.S. Pat. No. 4,473,239 discloses a stabilizer pad assembly or foot construction for outriggers or stabilizer arms. The stabilizer pad assembly or foot construction includes a housing which supports a reversible stabilizer pad having a smooth surface for engaging the ground to prevent slippage thereon and having an H-shaped cleat for embedding in the ground surface.

U.S. Pat. No. 4,491,450 discloses an apparatus for picking up and laying down drill pipe casing or similar. The apparatus includes an assembly with a transverse member or blade having a plurality of projection for digging into the ground to prevent the apparatus from tipping under load.

U.S. Pat. No. 5,667,245 discloses a reversible stabilizer pad for use with stabilizer arms of vehicles such as earth moving equipment or other construction vehicles. The stabilizer pad is coupled to the stabilizer arm so as to be pivotable about an axis of rotation. The stabilizer pad has a plate with first and second faces adapted to provide optimal areas of contact with the ground, the first face adapted for contacting soft earth or gravel and the second face adapted for contacting asphalt, concrete, or other hard surfaces. The stabilizer pad is rotatable about the pivot in order to be able to contact the ground with either the first or second face towards the ground. In this way, the apparatus prevents the pivotally mounted, two-way stabilizer pad from reversing its orientation under its own weight.

Another conventional anchoring assembly has a main body portion which includes a stake-down plate. The stake-down plate is a rectangular metal plate, wherein the front and rear long edges thereof have been bent upwardly to make the stake-down plate have an elongated U-shape in cross-section from front to rear. The stake-down plate has top and bottom smooth surfaces, wherein metal stabilizers are welded to the top surface of the stake-down plate to give it rigidity.

The anchoring assembly also includes stakes which can be screwed in or hydraulically driven into the ground or other support surface on which the anchoring assembly is positioned. The stakes help anchor the anchoring assembly to the support surface in order to resist sliding of the drilling machine during drilling operations.

Before drilling operations begin, the anchoring assembly is positioned on the ground or other support surface, and the stakes of the stake-down system of the anchoring assembly are either screwed-in or hydraulically driven into the ground to anchor the anchoring assembly. The stakes may be screwed-in or driven into the support surface so as to be vertical or at an angle to horizontal.

However, even with the stakes of the stake-down system of the anchoring assembly in place in the ground or other support surface, the advancing of the drill bit tends to create a force applied to the drill stem which urges movement of the tracked vehicle drilling machine with respect to the anchoring assembly. Furthermore, when withdrawing the drill bit, there is also a tendency to urge movement of the tracked vehicle drilling machine with respect to the anchoring assembly.

In some drilling applications, it is not possible or desirable to drive the stakes into the ground. The earth may be frozen or there may be electrical cable or similar directly beneath the intended staking location. In these types of situations, the tendency of the drilling machine to slide is particularly troublesome.

While a variety of anchoring devices for drilling equipment exist, substantial problems are associated with such devices. There is a need for significant improvement in anchoring devices for such equipment.

SUMMARY OF THE INVENTION

A gripping apparatus is provided which includes gripping mechanisms for improved resistance to sliding of a drilling machine in first and second directions during drilling operations. The anchoring assembly is supported on a support surface and the drilling machine includes a reciprocating drill mounted on the boom thereof The reciprocating drill generates thrust and pullback forces which tend to cause the drilling machine to slide in first and second directions.

The gripping apparatus of the present invention includes gripping mechanisms for resisting sliding of the drilling machine in first and second directions during drilling operations. A first gripping mechanism is pivotably mounted on the anchoring assembly. The first gripping mechanism is moveable between a first disengaged storage position and a second support surface engaging work position to resist sliding of the drilling machine during drilling operations. The first gripping mechanism includes a plurality of teeth for gripping the support surface and is pivotably mounted on a front of the anchoring assembly for resisting sliding of the drilling machine during drilling operations.

The gripping apparatus of the present invention may also include a second gripping mechanism. The second gripping mechanism, similar to the first gripping mechanism, is pivotably mounted on the anchoring assembly and is moveable between a first disengaged storage position and a second support surface engaging work position to resist sliding of the drilling machine in first and second directions during drilling operations. The second gripping mechanism includes a plurality of teeth for gripping the support surface and is pivotably mounted on a rear of the anchoring assembly for resisting sliding in a second direction.

Both the first and second gripping mechanisms include a plate with a plurality of arms extending perpendicularly therefrom. Each arm of the plurality of arms has a hole therethrough for mating with a fastener to pivotably attach each of the first and second gripping mechanisms to the anchoring assembly of the drilling machine. The plurality of teeth of both the first and second gripping mechanisms extend from the plate and each tooth of the plurality of teeth is approximately triangularly-shaped or may be triangular with a blunt end edge.

The anchoring assembly of the drilling machine is connected to a rear end of a boom of the drilling machine for anchoring the drilling machine to the support surface. The anchoring assembly includes a plurality of stakes moveable between a first, retracted position and a second, extended position. The second, extended position is when the plurality of stakes are anchored in the support surface. The anchoring assembly also includes either one or both of the first and second gripping mechanisms described above.

The present invention also includes a method of using the gripping apparatus to resist sliding of a drilling machine in first and second directions during drilling operations. The method includes providing the drilling machine with the anchoring assembly attached to a boom at the rear end of the drilling machine, wherein the anchoring assembly has a gripping apparatus pivotably mounted thereon. The first and second gripping mechanisms of the gripping apparatus are pivoted from a first disengaged storage position to a second support surface engaging work position. The anchoring assembly is supported on the support surface and drilling operations are begun. As the drilling operation progresses, the first and second gripping mechanisms work their way into the support surface to "bite" or grip the support surface to resist sliding of the drilling machine towards and away from the anchoring assembly, respectively.

The step of pivoting the first and second gripping mechanisms of the gripping apparatus from the first disengaged storage position to the second support surface engaging work position includes using stops to stop the first and second gripping mechanisms from pivoting past perpendicular to the anchoring assembly and to stabilize the first and second gripping mechanisms, when the first and second gripping mechanisms are in the second support surface engaging work position.

BRIEF DESCRIPTION OF THE DRAWING FIGURES

DETAILED DESCRIPTION OF THE INVENTION

Figure 1:
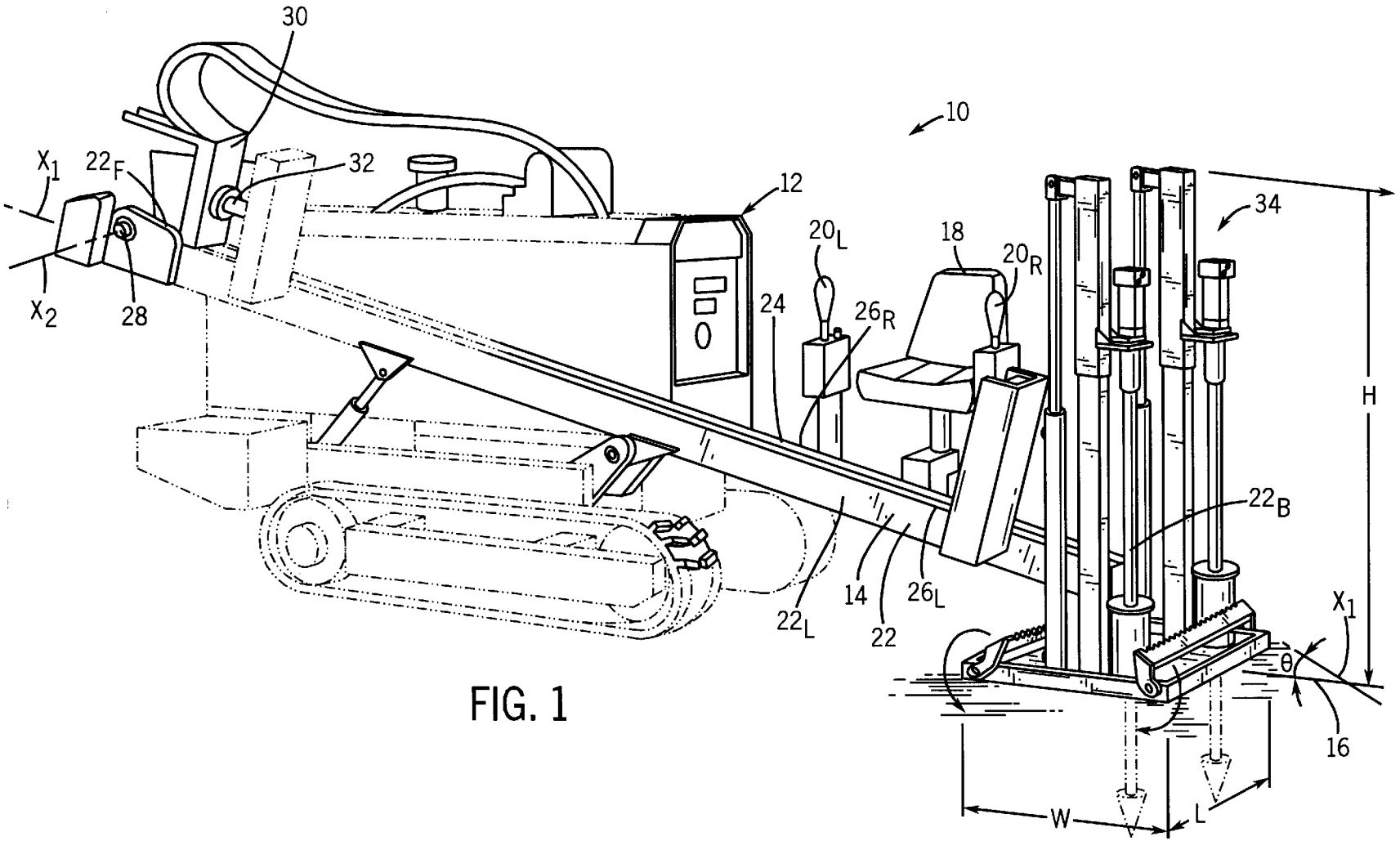
FIG. 1 is a perspective view of a horizontal directional drilling machine with an anchoring assembly attached thereto, the anchoring assembly including gripping apparatus for resisting sliding of the drilling machine during drilling operations.

The gripping apparatus of the present invention, for resisting sliding of the drilling machine during drilling operations, will now be described with reference to the drawing figures.

Referring to FIG. 1, a horizontal directional drilling machine 10 is shown. The drilling machine 10 includes a tracked vehicle or tractor 12. The tracked vehicle or tractor 12 supports a drill boom 14 so that a longitudinal axis $X_1$ of the drill boom 14 is at an angle θ to the support surface 16 on which the drilling machine 10 is supported. The tracked vehicle or tractor 12 includes an operator's seat 18 at which left and right control mechanisms $\mathbf{20}_L$, $\mathbf{20}_R$ are positioned. The control mechanisms $\mathbf{20}_L$, $\mathbf{20}_R$ allow an operator to control operation of the drilling machine 10 including the position and operation of the drill (not shown) mounted on the drill boom 14.

The drill boom 14 includes a support frame 22. The support frame 22 has a front end $\mathbf{22}_F$ and a back end $\mathbf{22}_B$. The support frame 22 also has spaced left and right side walls (only the left side wall $\mathbf{22}_L$ being shown in FIG. 1). The spaced left and right side walls $\mathbf{22}_L$ and (not shown) are interconnected by front and rear end walls (not shown in FIG. 1) so as to define a drilling system receiving cavity 24. Upper edges of left and right side walls $\mathbf{22}_L$ and (not shown) of the support frame 22 have left and right guide tracks $\mathbf{26}_L$ and $\mathbf{26}_R$. The left and right guide tracks $\mathbf{26}_L$ and $\mathbf{26}_R$ extend laterally in a cantilever manner from the upper edges of the left and right side walls $\mathbf{22}_L$ and (not shown). Each of the guide tracks $\mathbf{26}_L$ and $\mathbf{26}_R$ is generally rectangular in cross-section. Left guide track $\mathbf{26}_L$ is defined by first and second sides (not shown) and right guide track is defined by first and second sides (not shown). The first and second sides (not shown) of the left and right guide tracks $26_L$, $26_R$, respectively, are interconnected by upper and lower guiding surfaces (not shown in FIG. 1).

The front and back ends $22_F$ and $22_B$ of the support frame 22 enclose corresponding sprockets (not shown) therein, as will be hereinafter further described. The front end $22_F$ of the support frame 22 makes up part of an enclosure (not shown) enclosing a rotatable drive sprocket shaft 28 therein which extends therethrough along an axis $X_2$ transverse to the longitudinal axis $X_1$ of the drill boom 14. A drive sprocket (not shown) is mounted on the drive sprocket shaft 28 such that the drive sprocket shaft 28 and the drive sprocket (not shown) rotate in unison. It is contemplated that drive sprocket shaft 28 be rotated by a conventional, bidirectional hydraulic motor (not shown).

A movable carriage 30 is slidably mounted on support frame 22. The carriage 30 includes a rotary motor (not shown) for rotating a shaft 32. The shaft 32 is adapted for receiving a drilling tool (not shown) such as a drill pipe or auger thereon. The operation of the drill boom 14 and drilling tool (not shown) is further described in commonly assigned, co-pending U.S. patent application Ser. No. 09/228,154, filed on Jan. 11, 1999, which is hereby incorporated by reference.

The drilling machine 10 of FIG. 1 also includes an anchoring assembly 34. The anchoring assembly 34 is pivotally mounted on the back end $22_B$ of the support frame 22 of the drill boom 14. The anchoring assembly 34 includes a gripping apparatus 36 pivotably mounted thereon. Both the anchoring assembly 34 and the gripping apparatus 36 will be described in more detail below with reference to FIG. 2.

Referring to FIGS. 2–5, the anchoring assembly 34 and the gripping apparatus 36 for resisting sliding of the drilling machine 10 in first and second directions A, B during drilling operations are shown in a partially disassembled state with the back of the anchoring assembly 34 being towards the front of the drawing figure. It should be noted that the anchoring assembly 34 is symmetrical across the length L dimension of the anchoring assembly 34 (see FIG. 1 which defines the length L, width W, and height H dimensions of the anchoring assembly 34).

Figure 2:
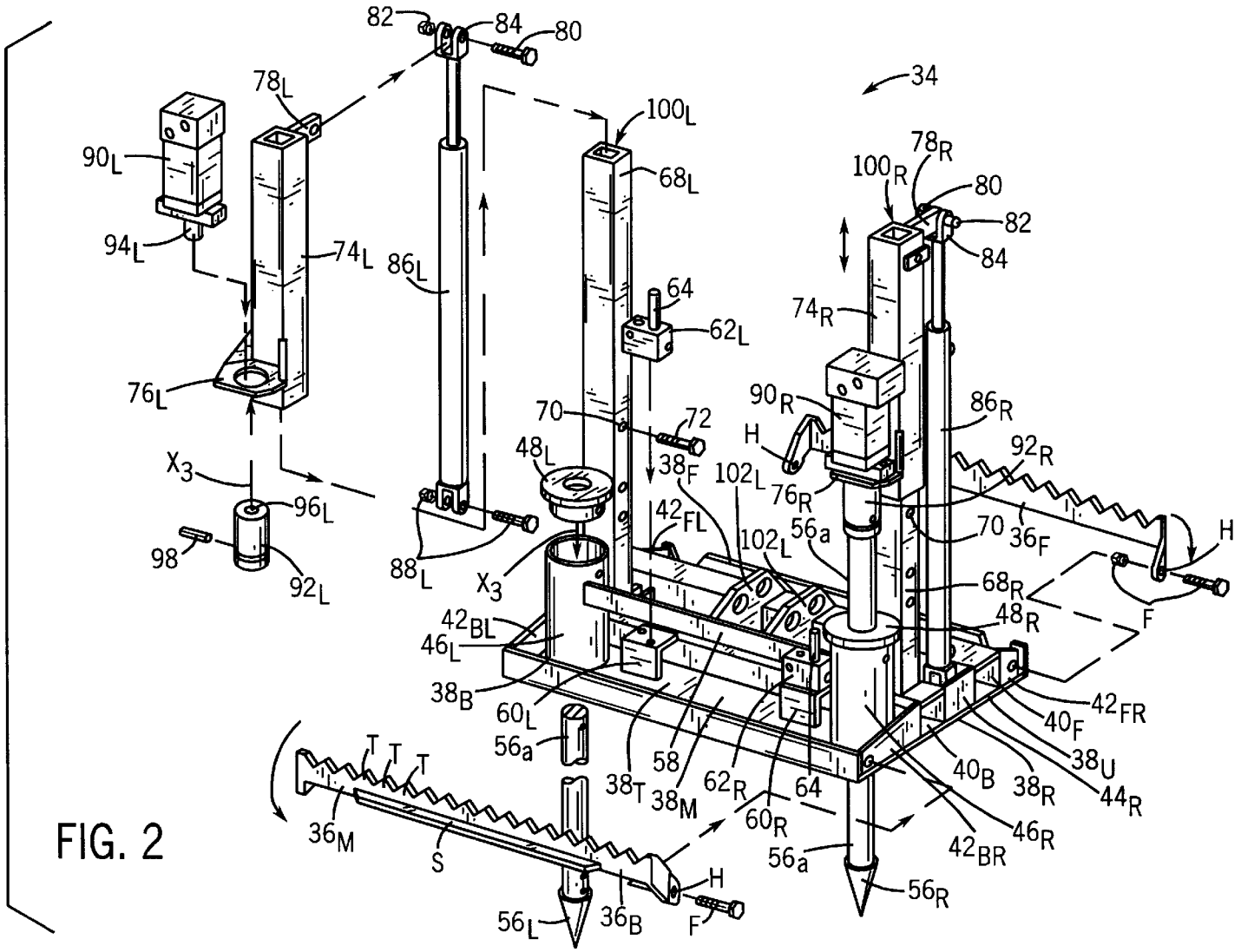
FIG. 2 is an exploded perspective view of the anchoring assembly and gripping apparatus for resisting sliding of the drilling machine during drilling operations.
Figure 3:
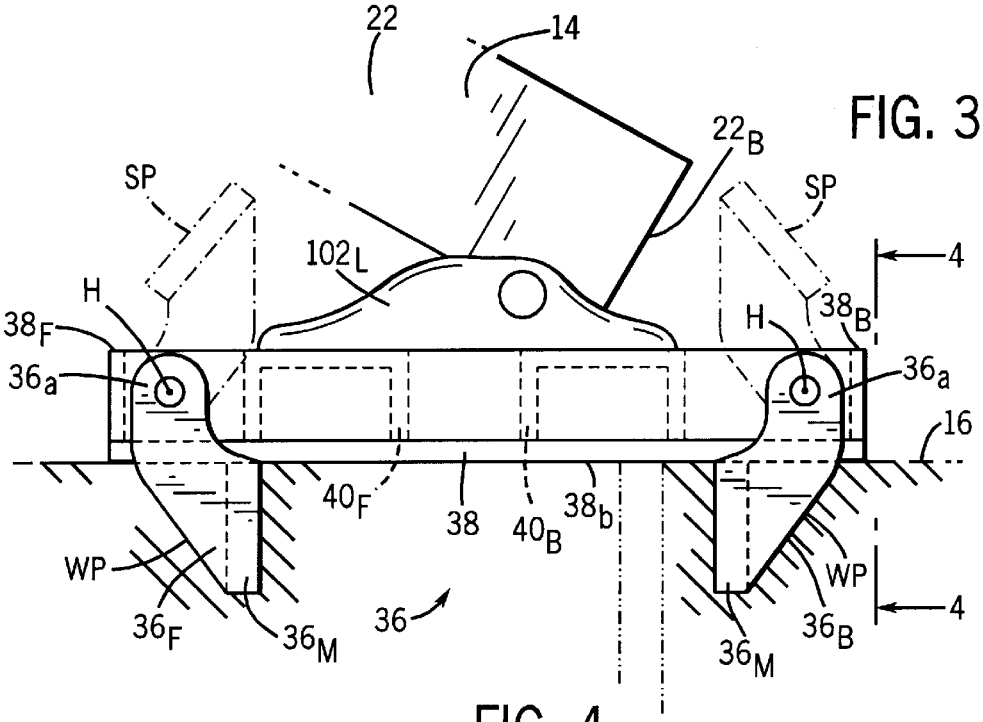
FIG. 3 is a side view of the anchoring assembly connected to the boom of the drilling machine showing the gripping mechanisms pivoted from the storage position, in dashed outline, to the work position wherein the gripping mechanisms penetrate the support surface.

The gripping apparatus 36 includes front and back gripping mechanisms $36_F$, $36_B$ which are shown in a first, disengaged storage position SP in FIGS. 1, 2, and 3 (in dashed outline) and in a second, support-surface-engaging work position WP in FIGS. 3 (in solid lines), 4, and 5. The front and back gripping mechanisms $36_F$, $36_B$ of the gripping apparatus 36 are for resisting sliding of the drilling machine 10 in first and second directions A, B (see FIG. 5) during drilling operations. Thus, the gripping apparatus 36 assists the anchoring assembly 34 in firmly holding the drilling machine 10 in place during drilling operations. More particularly, the gripping mechanisms $36_F$, $36_B$ of the gripping apparatus 36 are especially good at resisting sliding during thrust and pullback operations of the drilling machine 10, which thrust and pullback forces tend to loosen the left and right stakes $56_L$, $56_R$ (described in more detail below) of the anchoring assembly 34.

The anchoring assembly 34 includes a stake-down plate 38 having a plurality of structural members, including front and back approximately rectangular cross-section metal tubes $40_F$, $40_B$ (to be described in more detail below), front-left, front-right, back-left, and back-right approximately trapezoidal-shaped metal plates $42_{FL}$, $42_{FR}$, $42_{BL}$, $42_{BR}$ (to be described in more detail below), and left and right approximately rectangular-shaped metal plates (not shown), $44_R$ (to be described in more detail below) connected thereto. The structural members are preferably connected to the stake-down plate 38 by welding, although the structural members may be connected to the stake-down plate 38 in any conventional manner necessary in order to accomplish the objectives of the present invention.

The stake-down plate 38 is originally a rectangular metal plate having long front and back edges $38_F$, $38_B$ and short left and right edges (not shown), $38_R$. However, the long front and back edges $38_F$, $38_B$ of the stake-down plate 38 are then bent upwardly to be approximately perpendicular to the main portion $38_M$ of the stake-down plate 38 so that the stake-down plate 38 has an elongated U-shaped cross-section $38_U$ from the front edge $38_F$ to the back edge $38_B$ of the stake-down plate 38. The main portion $38_M$ of the stake-down plate 38 has smooth top and bottom surfaces $38_t$, $38_b$. The stake-down plate 38 is rigidified via the connection of the plurality of structural members the top surface $38_t$ of the main portion $38_M$ of the stake down plate 38 and thus, the bottom surface $38_b$ of the main portion $38_M$ of the stake down plate 38 is left smooth for better contact and support of the anchoring assembly 34 on the support surface 16.

Front and back approximately rectangular cross-section metal tubes $40_F$, $40_B$ are connected lengthwise, preferably by welding, to the top surface $38_t$ of the main portion $38_M$ of the stake-down plate 38 to give the stake-down plate 38 some rigidity. The stake-down plate 38 is further rigidified by (with particular reference to FIG. 2) front-left, front-right, back-left, and back-right approximately trapezoidal-shaped metal plates $42_{FL}$, $42_{FR}$, $42_{BL}$, $42_{BR}$ that are connected, preferably by welding, so as to be perpendicular to the main portion $38_M$ of the stake-down plate 38, to be near the left and right edges (not shown), $38_R$ of the stake-down plate 38, and to be between the front and back bent-up edges $38_F$, $38_B$ of the stake down plate 38 and the front and back welded-on rectangular cross-section metal tubes $40_F$, $40_B$. The stake-down plate 38 is provided with even further rigidity by left and right approximately rectangular-shaped metal plates (not shown), $44_R$ which are connected, preferably by welding, near the left and right edges (not shown), $38_R$ of the stake-down plate 38 so as to be perpendicular to the stake-down plate 38 and to be between the front and back rectangular cross-section metal tubes $40_F$, $40_B$.

Left and right approximately circular cross-section metal tubes $46_L$, $46_R$ are connected, preferably by welding, to the top surface $38_t$ of the main portion $38_M$ of the stake-down plate 38 between the back edge $38_B$ of the stake-down plate 38 and the back rectangular cross-section metal tube $40_B$ so that the circular cross-sections of the left and right circular cross-section metal tubes $46_L$, $46_R$ are parallel to the top surface $38_t$ of the main portion $38_M$ of the stake-down plate 38 and so that the longitudinal axis $X_3$ of the left and right circular cross-section metal tubes $46_L$, $46_R$ are perpendicular to the main portion $38_M$ of the stake-down plate 38. The left and right circular cross-section metal tubes $46_L$, $46_R$ include left and right annular covers $48_L$, $48_R$, respectively, that are removably attachable to the top of the left and right circular cross-section metal tubes $46_L$, $46_R$, respectively, via fasteners such as nuts and bolts or pins. The left and right circular cross-section metal tubes $46_L$, $46_R$ are capable of reciprocatingly accepting the top of shaft portions $56_a$, $56_a$ of left and right stakes $56_L$, $56_R$ which are to be driven into the support surface 16 on which the anchoring assembly 34 is positioned to hold the drilling machine 10 in place. The shaft portions $56_a$, $56_a$ of the left and right stakes $56_L$, $56_R$ are capable of being retracted and extended through the openings in the annular covers $48_L$, $48_R$ of the left and right circular cross-section metal tubes $46_L$, $46_R$. The left and right stakes $56_L$, $56_R$ are most likely hydraulically driven into the support surface 16, although other means of driving the left and right stakes $56_L$, $56_R$ penetratingly into the support surface 16 could be used.

A rectangular metal plate 58 is connected, preferably by welding, from the left circular cross-section metal tube $46_L$ to the right circular cross-section metal tube $46_R$ for rigidity purposes. Left and right L-shaped structural members $60_L$, $60_R$ are attached, preferably by welding, between the left and right circular cross-section metal tubes $46_L$, $46_R$. First ends of the left and right L-shaped members $60_L$, $60_R$ respectively, are attached to the back surface of the back rectangular cross-section metal tube $40_B$. Second ends of the left and right L-shaped members $60_L$, $60_R$, respectively, are attached to the top surface $38_t$ of the main portion $38_M$ of the stake-down plate 38. The left and right L-shaped members $60_L$, $60_R$ have top surfaces on which left and right solenoids $62_L$, $62_R$ are attached via bolts 64 and nuts (not shown).

Left and right approximately square cross-section metal tubes $68_L$, $68_R$ are connected, preferably by welding, to the top surface of the front rectangular cross-section metal tube $40_F$ which have been connected to the top surface $38_t$ of the main portion $38_M$ of the stake-down plate 38. The left and right square cross-section metal tubes $68_L$, $68_R$ have a plurality of spaced holes 70 through the left and right sides thereof for acceptance of pins 72 therethrough.

Left and right hollow approximately square cross-section metal sleeves $74_L$, $74_R$ of dimensions only slightly larger than the dimensions of the left and right square cross-section metal tubes $68_L$, $68_R$ fit over the square cross-section metal tubes $68_L$, $68_R$ and come to rest against the pins 72 inserted through the holes 70 in the left and right square cross-section metal tubes $68_L$, $68_R$. Left and right metal plates $76_L$, $76_R$ with circular openings therethrough are attached, preferably by welding, to a back surface of each the left and right square sleeves $74_L$, $74_R$ so that the longitudinal axis of the left and right metal plates $76_L$, $76_R$ is perpendicular to the left and right square cross-section metal sleeve $74_L$, $74_R$. In this way, the shafts $56_a$, $56_a$ of the stakes $56_L$, $56_R$ extending through the openings in the left and right annular covers $48_L$, $48_R$ of the left and right circular cross-section metal tubes $46_L$, $46_R$ are capable of being extended and retracted through the circular openings of the metal plates $76_L$, $76_R$.

Left and right metal plates $78_L$, $78_R$ are attached, preferably by welding, to back surfaces of the left and right sleeves $74_L$, $74_R$ so that the longitudinal axis of the left and right metal plates $78_L$, $78_R$ is parallel to the longitudinal axis of the left and right metal sleeves $74_L$, $74_R$. The left and right metal plates $78_L$, $78_R$ have holes therethrough for mating with a bolt 80 and nut 82 arrangement to connect to left and right devises 84 of left and right telescoping hydraulic cylinder assembles $86_L$, $86_R$. The left and right telescoping hydraulic cylinder assemblies $86_L$, $86_R$ are connected via left and right connectors $88_L$, (not shown) to the top surface $38_t$ of the main portion $38_M$ of the stake-down plate 38.

Left and right stake-heads $90_L$, $90_R$ are connected to the tops of the shafts $56_a$, $56_a$ of the left and right stakes $56_L$, $56_R$ via left and right connectors $92_L$, $92_R$. The left and right stake-heads $90_L$, $90_R$ have left and right rods $94_L$, (not shown), respectively, which protrude from an end thereof through the opening in the left and right metal plates $76_L$, $76_R$ attached to the front of the left and right square metal sleeve $74_L$, $74_R$. The left and right rods $94_L$, (not shown) fit in left and right recesses $96_L$, (not shown), respectively, in the tops of the left and right connectors $92_L$, $92_R$. The bottoms of the left and right connectors $92_L$, $92_R$ are connected to the top portions of the shafts $56_a$, $56_a$ of the left and right stakes $56_L$, $56_R$ via a pin 98. In this way, the left and right stake-heads $90_L$, $90_R$ are capable of reciprocating up and down with the left and right square metal sleeves $74_L$, $74_R$ in order to provide additional weight and surface area to help drive the left and right stakes $56_L$, $56_R$ of the anchoring assembly 34 penetratingly into the support surface 16.

Together the left and right hydraulic cylinders $86_L$, $86_R$, left and right square sleeves $74_L$, $74_R$, left and right square cross-section metal tubes $68_L$, $68_R$, left and right stake-heads $90_L$, $90_R$, and left and right connectors $92_L$, $92_R$ constitute left and right stake-drilling assemblies $100_L$, $100_R$ for penetratingly driving the stakes $56_L$, $56_R$, the tops of which reciprocate through the openings in the left and right circular cross-section metal tubes $46_L$, $46_R$ and into the support surface 16 so that the anchoring assembly 34 can anchor the drilling machine 10 in place at a selected location Two metal plates $102_L$, $102_R$ with each having two openings therethrough are attached, preferably by welding, to the back rectangular metal tube $40_B$ attached lengthwise to the top of the stake-down plate 38. These two metal plates $102_L$, $102_R$ with openings therethrough serve as a means for attaching the anchoring assembly 34 to the boom 14 of the horizontal drill machine 10.

Figure 4:
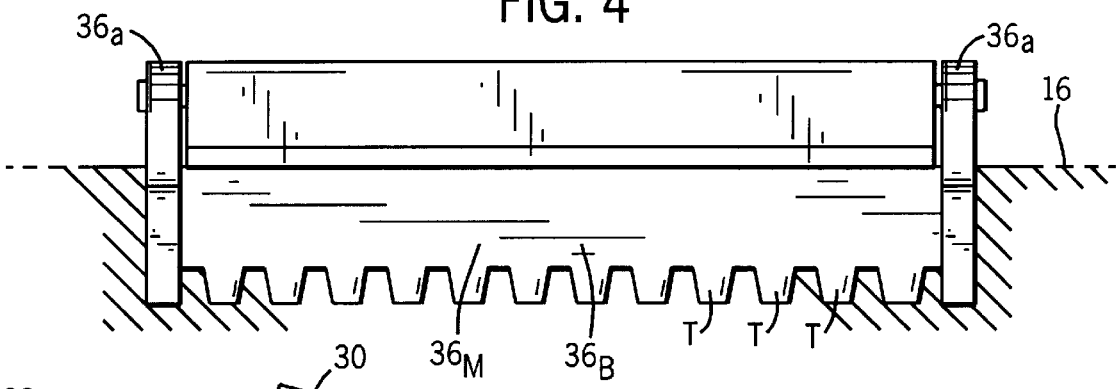
FIG. 4 is a rear view of a portion of the anchoring assembly taken along line 4—4 of FIG. 3, showing the stake-down plate and back gripping mechanism, wherein the back gripping mechanism penetrates the support surface.

The gripping apparatus 36 may include one or more gripping mechanisms $36_F$, $36_B$. Each of the gripping mechanisms $36_F$, $36_B$ includes a main body portion $36_M$, (not shown) which is a solid, preferably metal (although any material of suitable strength could be used) plate, which in the embodiment shown in FIG. 2 is approximately rectangular having two long sides and two short sides. A plurality of teeth T extend from one of the long sides of main body portions $36_M$ of the gripping mechanisms $36_F$, $36_B$ of FIG. 2. The teeth T are shown as having an approximately triangular shape, although the teeth T may be of any shape, such as triangular with a blunt end as shown in FIG. 4, necessary to be able to "bite" into or grip the ground or other support surface 16 on which the anchoring assembly 34 is positioned in order to carry out the objectives of the present invention.

Each of the gripping mechanisms $36_F$, $36_B$ includes a pair of arms $36_a$ which extend approximately perpendicularly from the main body portions $36_M$. Each of the arms $36_a$ have a hole H therethrough for mating acceptance of a fastener F in order to be able to pivotably attach the gripping mechanisms $36_F$, $36_B$ to the anchoring assembly 34. In the embodiment shown in FIG. 2, the fasteners F include a pair of bolts and nuts, but any manner of pivotably attaching the gripping mechanisms $36_F$, $36_B$ could be used.

Each of the gripping mechanisms $36_F$, $36_B$ also includes a stop S. The stop S is preferably a metal, or other material of suitable strength, plate attached to a long edge of the rear of the plate opposite the long edge along which the teeth T extend. The stop S extends perpendicularly from the plate in a direction opposite to the direction the arms $36_a$ of the gripping mechanisms $36_F$, $36_B$ extend. When the gripping mechanisms $36_F$, $36_B$ are in the first disengaged storage position, the stops S are not in contact with any surface of the anchoring assembly 34. However, when the gripping mechanisms $36_F$, $36_B$ are pivoted into the second support surface engaging work position, the stops S contact the bottom of the stake-down plate 38 of the anchoring assembly 34 in order to stabilize the gripping mechanisms $36_F$, $36_B$ and in order to stop the gripping mechanisms $36_F$, $36_B$ so that they remain perpendicular to the bottom surface $38_b$ of the main portion $38_M$ of stake-down plate 38 of the anchoring assembly 34.

Referring to FIG. 3, schematic drawings are shown which depict the gripping mechanisms $36_F$, $36_B$ of the gripping apparatus 36 attached to the anchoring assembly 34 which is in turn attached to the boom 14 of the drilling machine 10. The pivoting of the gripping mechanisms $36_F$, $36_B$ is illustrated via the dashed lines. The gripping mechanisms $36_F$, $36_B$ is being pivoted from a first disengaged storage position SP (shown in dashed outline) to a second support-surface-engaging work position WP.

FIG. 4 shows a back view of the back gripping mechanism $36_B$ in its support-surface-engaging work position WP, wherein the teeth T of the gripping mechanism $36_B$ have worked their way into the support surface 16. It should be noted that the length of each of the gripping mechanisms $36_F$, $36_B$ between arms $36_a$ is slightly larger than the dimension the long front and back edges $38_F$, $38_B$ of the stake-down plate 38 in order for there to be some clearance to allow for the gripping mechanism $36_F$, $36_B$ to pivot from their storage position SP to their support-surface-engaging work position WP.

Figure 5:
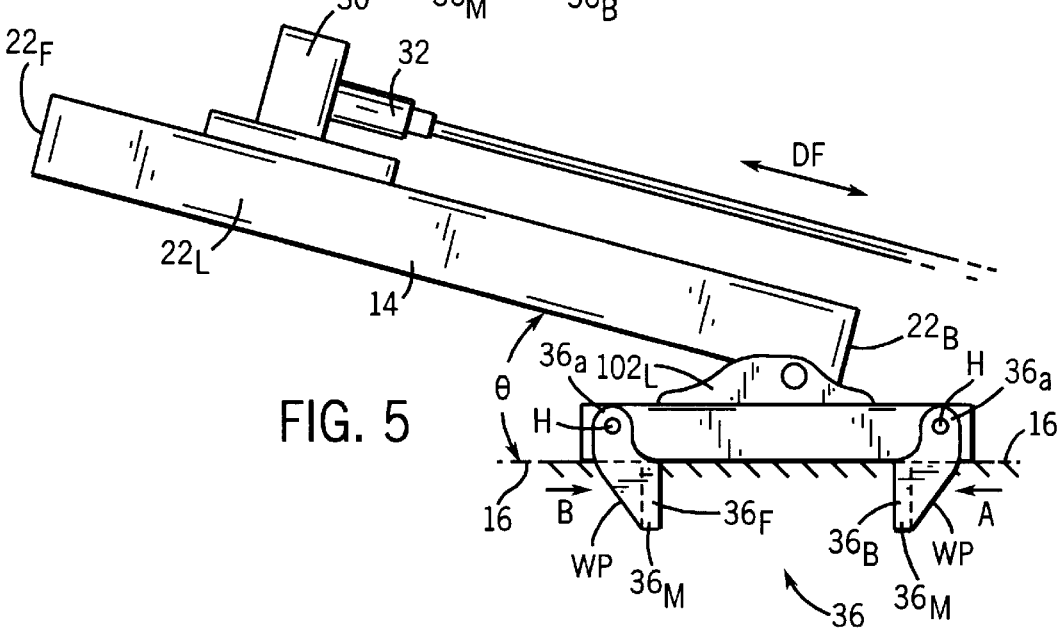
FIG. 5 is a side view of the drill boom attached to a portion of the anchoring assembly showing both the reciprocating direction of the drill force and the directions in which the gripping mechanisms resist sliding to become embedded in the support surface.

FIG. 5 illustrates the anchoring assembly 34 attached to the boom 14 of the drilling machine 10. The gripping mechanisms $36_F$, $36_B$ of the gripping apparatus 36 for resisting sliding of the drilling machine 10 during drilling operations are shown in the second support-surface-engaging work position WP. The directions of the drill force DF during thrust and pull-back operations is shown by double-headed arrow as being parallel to the declined boom 14 of the drilling machine 10 and at an angle θ to the support surface 16. One of the gripping mechanisms $36_F$, $36_B$ of the gripping apparatus 36 for resisting sliding of the drilling machine 10 during drilling operations is for resisting pull-back forces of the drilling machine 10 during operation of the drill (not shown) to keep the drilling machine 10 from sliding in a first direction A. The other one of the gripping mechanisms $36_F$, $36_B$ of the gripping apparatus 36 for resisting sliding of the drilling machine 10 during drilling operations is for resisting thrust forces of the drilling machine 10 during operation of the drill (not shown) to keep the drilling machine 10 from sliding in a second direction B.

In operation, a drilling machine 10 and anchoring assembly 34 are positioned in a place where a hole is to be drilled. The gripping mechanisms $36_F$, $36_B$ of the gripping apparatus 36 for resisting sliding of the drilling machine 10 are attached to the anchoring assembly 34. The anchoring assembly 34 is in turn attached to the end of the boom 14 of the drilling machine 10. The gripping mechanisms $36_F$, $36_B$ are readied by being pivoted from a first disengaged storage position SP to a second support-surface-engaging work position WP. The anchoring assembly 34 is positioned on the support surface 16 and stakes $56_L$, $56_R$ of the anchoring assembly 34 are either screwed-in or hydraulically driven into the support surface 16 in order to partially hold the drilling machine 10 in place. The drilling machine 10 is activated and the reciprocating drill (not shown) begins to reciprocate back and forth along the boom 14, thereby generating thrust and pull-back drill forces DF. As the drill (not shown) continues its reciprocating movement, the gripping mechanisms $36_F$, $36_B$ of the gripping apparatus 36 for resisting sliding of the drilling machine 10 which have been pivoted to the second support-surface-engaging work position WP are worked into the support surface 16 to "bite" into the support surface 16 to resist sliding of the drilling machine 10 in the first and second directions A, B during drilling operations.

The pivoting the first and second gripping mechanisms $36_F$, $36_B$ of the gripping apparatus 36 from the first disengaged storage position SP to the second support-surface-engaging work position WP is stopped with the aid of a stop S attached to the gripping mechanisms $36_F$, $36_B$. The stops S stop the gripping mechanisms $36_F$, $36_B$ from pivoting past perpendicular to the bottom surface $38_b$ of the main portion $38_M$ of the stake-down plate 38 of the anchoring assembly 34. The stops S contacts the bottom surface $38_b$ of the main portion $38_M$ of the stake-down plate 38 of the anchoring assembly 34 and thus, also act to stabilize the gripping mechanisms $36_F$, $36_B$.

While the principles of the present invention have been shown and described in connection with the drawing figures, it is to be clearly understood that the embodiments described herein are by way of example only and are not limiting.

We claim:

1. A gripping apparatus for resisting sliding of a drilling machine in first and second directions during drilling operations, wherein an anchoring assembly is anchored to and supported on a support surface and the drilling machine has a reciprocating drill which generates thrust and pullback forces which tend to make the drilling machine slide in the first and second directions, respectively, the gripping apparatus comprising:

a first gripping mechanism pivotably mounted on the anchoring assembly, the first gripping mechanism being moveable between a disengaged storage position and a support-surface-engaging work position to resist sliding of the drilling machine during drilling operations; and a plurality of teeth extending from the first gripping mechanism for gripping the support surface when the first gripping mechanism is in the work position.

2. The gripping apparatus of claim 1, wherein the first gripping mechanism is pivotably mounted on a front of the anchoring assembly for resisting sliding of the drilling machine in the first direction.

3. The gripping apparatus of claim 2, wherein the first gripping mechanism includes a plate with a plurality of arms extending perpendicularly therefrom, each arm of the plurality of arms having a hole therethrough for mating with a fastener to pivotably attach the first gripping mechanism to the anchoring assembly of the drilling machine.

4. The gripping apparatus of claim 3, wherein the plurality of teeth extend from the plate and each tooth of the plurality of teeth are any one of approximately triangularly-shaped and approximately triangularly-shaped with a blunt end.

5. The gripping apparatus of claim 4, wherein the plate of the first gripping mechanism has a stop attached to a back thereof, the stop being for stabilizing the first gripping mechanism and for preventing pivoting of the plate past perpendicular to the anchoring assembly when the first gripping mechanism is in the second, support surface engaging position.

6. The gripping apparatus of claim 1, further comprising a second gripping mechanism pivotably mounted on the anchoring assembly, wherein the second gripping mechanism is moveable between a first, disengaged position and a second, support surface engaging position to resist sliding of the drilling machine during drilling operations.

7. The gripping apparatus of claim 6 a plurality of teeth extending from the second gripping mechanism for gripping the support surface when the second gripping mechanism is in the engaging position.

8. The gripping apparatus of claim 7, therein the second gripping mechanism is pivotably mounted on a rear of the anchoring assembly for resisting sliding of the drilling machine in the second direction.

9. The gripping apparatus of claim 7, wherein the second gripping mechanism includes a plate with a plurality of arms extending perpendicularly therefrom, each arm of the plurality of arms having a hole therethrough for mating with a fastener to pivotably attach the second gripping mechanism to the anchoring assembly of the drilling machine.

10. The gripping apparatus of claim 9, wherein the plurality of teeth extend from the plate of the second gripping mechanism and each tooth of the plurality of teeth are any one of approximately triangularly-shaped and approximately triangularly-shaped with a blunt-end.

11. An anchoring assembly of a drilling machine, the anchoring assembly being supported on a support surface and connected to a rear end of a boom of the drilling machine for anchoring the drilling machine to the support surface, and the drilling machine having a reciprocating drill generating thrust and pullback forces, the anchoring assembly comprising:

a plurality of stakes moveable between a first, retracted position and a second, extended position, the second, extended position being wherein the plurality of stakes are anchored in the support surface; and a gripping apparatus including a first gripping mechanism, wherein the first gripping mechanism is pivotably mounted on the anchoring assembly, the first gripping mechanism being moveable between a first, disengaged position and a second, support surface engaging position to resist sliding of the drilling machine during drilling operations.

12. The anchoring assembly of claim 11, wherein the gripping apparatus further comprises a second gripping mechanism pivotably mounted on the anchoring assembly, the second gripping mechanism being moveable between a first disengaged storage position and a second support surface engaging work position to resist sliding of the drilling machine during drilling operations.

13. The anchoring assembly of claim 12, wherein the first and second gripping mechanisms each include a plurality of teeth for gripping the support surface and wherein each of the first and second gripping mechanisms are pivotably mounted on a front and a rear, respectively, of the anchoring assembly for resisting sliding of the drilling machine in the first and second directions, respectively.

14. A drilling machine comprising:

a reciprocating drill mounted on a boom of a drilling machine, wherein the reciprocating drill generates thrust and pullback forces;

an anchoring assembly supported on a support surface and connected to a rear end of the boom of the drilling machine for anchoring the drilling machine to the support surface, the anchoring assembly including a plurality of stakes moveable between a first, retracted position and a second, extended position, the second, extended position wherein the plurality of stakes are anchored in the support surface; and a gripping apparatus including a first gripping mechanism, wherein the first gripping mechanism is pivotably mounted on the anchoring assembly, the first gripping mechanism being moveable between a first disengaged storage position and a second support surface engaging work position to resist sliding of the drilling machine in a first direction during drilling operations.

15. The drilling machine of claim 14, wherein the gripping apparatus further comprises a second gripping mechanism pivotably mounted on the anchoring assembly, the second gripping mechanism being moveable between a first disengaged storage position and a second support surface engaging work position to resist sliding of the drilling machine in a second direction during drilling operations.

16. The drilling machine of claim 15, wherein the first and second gripping mechanisms each include a plurality of teeth for gripping the support surface and wherein each of the first and second gripping mechanisms are pivotably mounted on a front and a rear, respectively, of the anchoring assembly for resisting sliding of the drilling machine in the first and second directions, respectively.

17. A method of using a gripping apparatus to resist sliding of a drilling machine in first and second directions, the method comprising the steps of:

providing the drilling machine with an anchoring assembly attached to a boom at the rear end of the drilling machine, wherein the anchoring assembly has a gripping apparatus pivotably mounted thereon;

pivoting a first gripping mechanism and a second gripping mechanism of the gripping apparatus from a first disengaged storage position to a second support surface engaging work position;

positioning the anchoring assembly on a support surface;

beginning drilling operations of the drilling machine;

allowing the first and second gripping mechanisms to grip the support surface to resist sliding of the drilling machine in the first and second directions, respectively.

18. The method of claim 17, wherein allowing the first and second gripping mechanisms to grip the support surface includes allowing teeth of the first and second gripping mechanisms to be worked into the support surface during operation of the drilling machine.

19. The method of claim 17, wherein pivoting the first and second gripping mechanisms of the gripping apparatus from the first disengaged storage position to the second support surface engaging work position includes using stops to stop the first and second gripping mechanisms from pivoting past perpendicular to the anchoring assembly and to stabilize the first and second gripping mechanisms, when the first and second gripping mechanisms are in the second support surface engaging work position.

* * * * *

UNITED STATES PATENT AND TRADEMARK OFFICE

CERTIFICATE OF CORRECTION

PATENT NO. : 6,131,674

DATED : October 17, 2000

INVENTOR(S) : Robert Draney and Jeffery Volden

It is certified that error appears in the above-identified patent and that said Letters Patent are hereby corrected as shown below:

In column 1, line 37, between "known" and "For", insert --.--.
In column 3, line 4, between "thereof" and "The", insert --.--.
In column 5, line 16-17, cancel "bidi-rectional" and substitute therefor --bi-directional--.
In column 7, line 55, cancel "devices" and substitute therefor --clevises--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*